US009038777B2

(12) United States Patent
Stearns et al.

(10) Patent No.: US 9,038,777 B2
(45) Date of Patent: May 26, 2015

(54) FALL PROTECTION SYSTEM

(71) Applicants: Jim Stearns, Boston, MA (US); Michael McDermott, Manchester, NH (US); Christopher Conley, Stoughton, MA (US); Steve Conley, Jr., Dorchester, MA (US); Cori Amadon, Westminster, MA (US); Francis Greenwood, Bourne, MA (US); Bernard Greaney, Milton, MA (US)

(72) Inventors: Jim Stearns, Boston, MA (US); Michael McDermott, Manchester, NH (US); Christopher Conley, Stoughton, MA (US); Steve Conley, Jr., Dorchester, MA (US); Cori Amadon, Westminster, MA (US); Francis Greenwood, Bourne, MA (US); Bernard Greaney, Milton, MA (US)

(73) Assignee: James F. Stearns Company LLP, Pembroke, MA (US)

( * ) Notice: Subject to any disclaimer, the term of this patent is extended or adjusted under 35 U.S.C. 154(b) by 24 days.

(21) Appl. No.: 13/772,136

(22) Filed: Feb. 20, 2013

(65) Prior Publication Data

US 2014/0102829 A1 Apr. 17, 2014

Related U.S. Application Data

(60) Provisional application No. 61/713,684, filed on Oct. 15, 2012.

(51) Int. Cl.
*A62B 1/22* (2006.01)
*E04G 21/32* (2006.01)

(52) U.S. Cl.
CPC ..... *E04G 21/3266* (2013.01); *A62B 1/22* (2013.01); *E04G 21/3204* (2013.01)

(58) Field of Classification Search
CPC .. A62B 1/22; E04G 21/3204; E04G 21/3223; E04G 21/3261; E04G 21/3266
USPC ..... 182/137, 138, 139; 482/27, 28, 29; 135/115
See application file for complete search history.

(56) References Cited

U.S. PATENT DOCUMENTS

| | | | | | |
|---|---|---|---|---|---|
| 384,923 | A | * | 6/1888 | Moore | 182/139 |
| 448,101 | A | * | 3/1891 | Whittier | 182/138 |
| 527,594 | A | * | 10/1894 | Dromgoole | 182/139 |
| 626,812 | A | * | 6/1899 | Kirschenhofer | 182/139 |
| 1,099,352 | A | * | 6/1914 | Foldi | 182/138 |
| 1,546,399 | A | * | 7/1925 | Moylan | 182/82 |
| 2,450,595 | A | * | 10/1948 | Jones | 182/82 |
| 3,527,319 | A | | 9/1970 | Pedley et al. | |
| 3,581,436 | A | * | 6/1971 | Basiger | 47/22.1 |
| 4,129,197 | A | * | 12/1978 | Preston | 182/82 |
| 4,351,413 | A | * | 9/1982 | Simon | 182/139 |
| 4,732,234 | A | | 3/1988 | Brickman | |
| 4,979,589 | A | * | 12/1990 | Sugiyama et al. | 182/38 |
| 4,981,225 | A | * | 1/1991 | Cole | 211/183 |
| 4,986,389 | A | | 1/1991 | Halligan, Sr. et al. | |
| 5,167,299 | A | * | 12/1992 | Nusbaum | 182/138 |
| 5,170,829 | A | * | 12/1992 | Duncan et al. | 160/84.02 |
| 5,429,206 | A | | 7/1995 | Nusbaum | |
| 5,673,769 | A | * | 10/1997 | Rexroad et al. | 182/138 |
| 5,787,955 | A | | 8/1998 | Dargie | |
| 6,035,967 | A | * | 3/2000 | Maeda | 182/138 |
| 6,068,085 | A | | 5/2000 | Denny et al. | |

(Continued)

*Primary Examiner* — Alvin Chin-Shue
*Assistant Examiner* — Colleen M Chavchavadze
(74) *Attorney, Agent, or Firm* — Lambert & Associates; Gary E. Lambert; David J. Connaughton, Jr.

(57) ABSTRACT

A fall protection system is provided providing all protection for all workers in building erection. The system involves an interior net, and a perimeter net if needed. The net system may be both horizontally and vertically mobile, allowing it to be easily moved as building erection continues.

7 Claims, 8 Drawing Sheets

(56) References Cited

U.S. PATENT DOCUMENTS

| | | | | |
|---|---|---|---|---|
| 6,098,750 | A | 8/2000 | Reynolds et al. | |
| 6,161,648 | A * | 12/2000 | Rexroad et al. | 182/138 |
| 6,305,310 | B1 * | 10/2001 | Ferri | 114/343 |
| 6,691,827 | B2 | 2/2004 | Lycett | |
| 8,627,619 | B2 * | 1/2014 | Heaney | 52/222 |
| 2002/0104710 | A1 * | 8/2002 | Thompson et al. | 182/138 |
| 2006/0090961 | A1 * | 5/2006 | Rexroad | 182/138 |
| 2006/0201744 | A1 * | 9/2006 | Curtis et al. | 182/138 |
| 2009/0120718 | A1 | 5/2009 | O'Gorman | |
| 2009/0159369 | A1 | 6/2009 | McCarthy | |
| 2012/0055738 | A1 * | 3/2012 | Larkin | 182/138 |

* cited by examiner

FALL PROTECTION SYSTEM

CROSS REFERENCE TO RELATED APPLICATIONS

This application is a non-provisional application of, and claims the benefit to, provisional Application No. 61/713,684 filed Oct. 15, 2012, which is currently pending.

BACKGROUND OF THE INVENTION

1. Field of the Invention

The present invention relates generally to a fall protection system for use in building construction. More particularly, the present invention relates to a complete fall protection system that provides netting about all potential fall areas.

2. Description of Related Art

In the construction of high-rise structures, it is vital that a system be in place whereby workmen performing connecting, bolting up and metal decking installation, or any other work from elevated areas, be protected from falling to lower levels. These falls may cause serious injury or even death. Indeed, steel work is consistently ranked as one of the most dangerous jobs in America. As such, there exists a tremendous need for safety improvements.

In today's construction industry, the demand for complete fall protection (all fall angles and positions) for workers exposed to falls of greater than 6 feet is nearly a mandate. Fall protection requirements are intended to improve and optimize the level of safety for workers.

Therefore, what is needed is a device that may provide complete fall protection in order to protect workers making initial connections of structural steel, among other things.

SUMMARY OF THE INVENTION

The subject matter of this application may involve, in some cases, interrelated products, alternative solutions to a particular problem, and/or a plurality of different uses of a single system or article.

In one aspect, a fall protection system is provided. The fall protection system comprises an interior net positioned substantially horizontally (generally horizontal orientation, with some sagging by the net across its area) across an interior span of a column structure. The interior net is slideably attached to the columns of the column structure by a clamp and/or a hoisting block. The clamps are configured to attach to the columns in any manner. In one embodiment, the clamp may attach about two flanges of a column, the clamp being slideable along these flanges when open, while immobile when closed. Alternatively, the net may be attached to the hoisting block, which may hold the net in place, and allow it to be moved up and down by cable movement through the hoisting block.

In another aspect, a method of moving and adjusting a fall protection system within a column structure is provided. The method begins with loosening a clamp attached to a column. In a particular embodiment, the clamp is attached to two flanges of a column. The clamp may then be removed from the column. Further, an interior net of the fall protection system is disconnected from the clamp. The clamp can be attached to two flanges of a different column, slid into position, and tightened thereon. The sliding of the clamp may occur by a user pulling a cable, the cable supported by a hoisting block positioned above the clamp, and connected to the clamp, such that pulling the cable raises the clamp. The interior net may be re-connected to the clamp.

DETAILED DESCRIPTION

Figure 1:
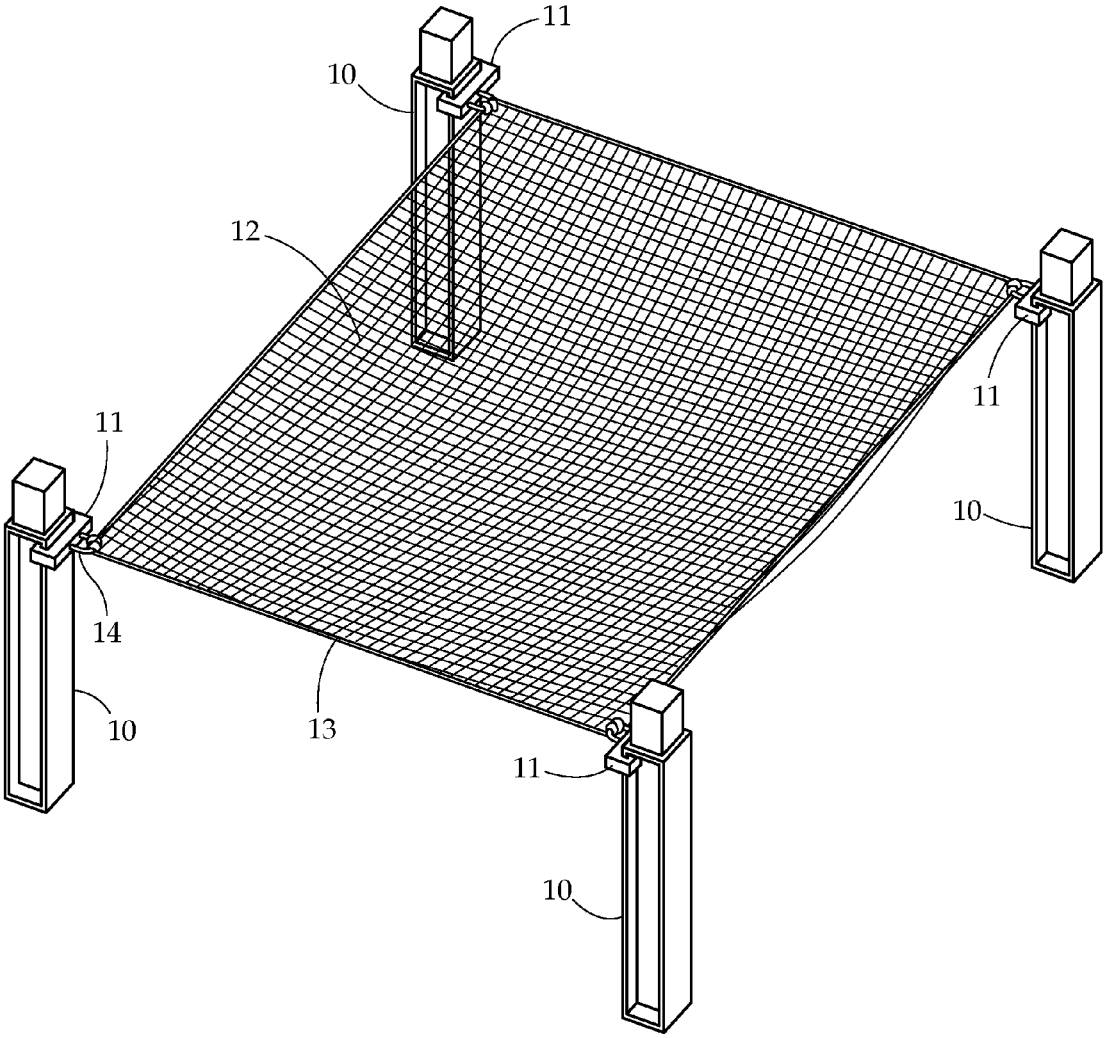
FIG. 1 provides a perspective view of an embodiment of the system.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a net system that provides fall protection for workers operating at elevation on a structure. In other words, workers are protected from a fall inward towards the center of the structure, and in addition, may optionally be protected from an outward fall away from the structure, in all directions. The system is easily movable in the horizontal and vertical directions along a building's structure, allowing it to move quickly as construction continues.

The columns forming the building structure may be of any structure capable of use in building erection. For example, columns may be made of steel or similar metal and may have an I-shaped cross section. Further, columns may be made of concrete, reinforced concrete, wood, or the like.

The present invention may be used in any application wherein workers are operating at elevation on any structure.

The net system may comprise an interior net covering an interior span, and a perimeter net covering a periphery of a structure. In some embodiments, these nets may operate in tandem to ensure complete fall protection. In other embodiments, just the interior net may be utilized, depending on needs and operating location. In operation, the net system may provide fall protection for both falls inward under the working area, and outward, away from the working area.

In operations when the working area has an edge on the perimeter of the structure, the perimeter net may be employed to catch a falling object or worker falling away from the structure. In operations when the working area is surrounded by the interior of the building (i.e. other working areas) additional interior nets may be utilized to catch a falling object or worker, not a perimeter net. In other words, perimeter nets protect falls away from the structure, while one or a plurality of interior nets protect falls within the interior of the structure. In one embodiment, the net may be tight enough to absorb a falling person or persons without the net sagging far enough for a falling worker to contact structures below the net. For example, the interior net may be tight enough to prevent sagging more than approximately 2-5 feet, and may be positioned so that a falling object or worker will not hit a structure below the net.

In embodiments discussed and shown herein, the net or nets may be a 4 inch by 4 inch knotted net. However, it should be understood that the term net may apply to any net structure capable of supporting the weight of a person.

The term cable is used frequently herein to refer to any number of long, flexible items. As used herein, "cable" may additionally refer to similar structures such as ropes, fibers, lines, strings, and the like.

The interior net may be any shape and size capable of catching a person in a fall, and capable of being positioned spanning a working area in a structure. In many embodiments the interior net may be rectangular. However, in other embodiments wherein a working area is not rectangular, the net may be configured to conform to the working area. In one embodiment, border ropes or cables may be manually installed according to the dimensions needed to fit a specific span.

The net may be constructed in any manner capable of providing a net capable of receiving a person after a fall. In one embodiment, the net may have reinforcing ropes or cables installed across its area. In a further embodiment, one or a plurality of robes or cables may be installed along diagonals of the net. In still a further embodiment, rectangular reinforcements may be positioned at varying positions on the net. For example, rectangular reinforcing ropes or cables may be positioned five feet from a center of the net, ten feet from a center of the net, and fifteen feet from a center of the net having the same center points.

These ropes or cables may be connected to the net and/or each other in any manner. In one embodiment, the ropes or cables may be woven through the net. In another embodiment, the ropes or cables may me physically attached to the net using, for example, a u-bolt or similar connecting device. In another embodiment, the cables or ropes may be woven along the net, and attached to other ropes by a physical connection.

In still another embodiment, the ropes or cables may be woven through the net, and mechanical securements may be utilized at intersections of the ropes or cables.

In one embodiment, ends of the reinforcing ropes or cables may be spliced together with either an end of another cable, or an end of the same cable. One manner of splicing cable ends may involve wrapping the ends about each other laterally, and clamping an end of each cable against a portion of the other. In a further embodiment, the reinforcing ropes may be attached to the corners of the net and perimeter cable.

The interior net may be positioned across a central gap within a structure around which workers are operating. Further, in some embodiments, the interior net may extend beyond the working area. In other embodiments, a plurality of interior nets may be arranged to protect from a fall outside of the working area. In varying embodiments, the interior net may be vertically mobile, horizontally mobile, or both.

In one embodiment wherein the interior net is vertically mobile, a pulley such as a hoisting block may be secured to a vertical structural column. The interior net structure may be held in place, and raised and lowered by adjusting its position via the pulley. In a further embodiment, a plurality of pulleys may be used. In still a further embodiment, four pulleys may be used, one on each of four corners of a rectangular interior net.

The pulley may be secured to the vertical structural column, or any other structural support member in any manner capable of securely supporting the pulley. In many embodiments, the pulley may be configured to hold the net in place in the event of a fall. In most embodiments the pulley is configured to support the weight of the interior net system as well as added forces during a fall when the interior net is catching a person or other material. In further embodiments, a secondary securement of the net to the vertical support columns may supplement added forces during a fall.

In one embodiment, the vertical support members, namely columns, may be pre-fabricated to provide anchors and similar structure to accommodate attachment of a pulley, and/or cables. In another embodiment, the structure to accommodate pulleys and cables may be welded to the column, or secured using a removable clamp.

In a further embodiment wherein the interior net is vertically mobile, one or a plurality of clamps may be utilized to secure the net in place to one or a plurality of vertical structural members. In one embodiment, a clamp may be configured to be slideably mounted around a flange of a column having an I-shaped cross section, the column serving as the vertical support member. This clamp may be tightened when the interior net is intended to be secured, and loosened when the interior net is to be moved. A plurality of such clamps may be used as needed to secure the net in varying building shapes.

In still a further embodiment, the one or plurality of clamps may further comprise a tightenable connection to the interior net. The tightenable connection may facilitate the application of proper tension on the net, in operation. The tightenable connection may allow tightening of the net at the point of connection to the clamp. The tightenable connection may be any structure capable of applying tension to the net at the clamp connection. In one embodiment, tightenable connection a ratcheting mechanism. In another embodiment the tightenable connection may be a strap and tooth locking mechanism. In another embodiment, the tightenable connection may be a threaded connector that may tighten or loosen the connection of the net to the clamp.

In another embodiment, the pulley and the clamp may be used in conjunction. In this embodiment, the pulley may be utilized to adjust the vertical position of the interior net. Then, once positioned, the clamp may be secured to a vertical support member in a manner capable of holding the net in position against forces experienced in a fall.

In a particular embodiment, the clamp may comprise a piece of C channel of adequate grade metal. The length of the C channel may be determined of the width of a flange of a column acting as a vertical support member. The camp C channel may have two 90 degree angled pieces of metal ("90 degree angle") mounted to it, one on each end. A first 90 degree angle is secured to a first end of the C channel by, for example, a weld. The other 90 degree angle is secured to a threaded rod, such as a Richmond rod, by two locking nuts. This connection allows the 90 degree angle to move freely through the gap of the C channel, allowing it to effectively clamp to the flange of the column. In the center space of the C channel there is a diaphragm to guide the threaded rod and create greater stability in the bracket for mounting to the column flange. In a further embodiment, at the top and bottom of the C channel there may be two lifting lugs, one on each side. The top side lifting lug for hoisting the clamp into proper vertical position. The bottom lug for attachment to the interior net.

In one embodiment wherein the interior net is horizontally mobile, the horizontal mobility may be achieved by sliding the net along cables extending between vertical support members. The horizontal mobility may be achieved in any manner capable of easily moving the net horizontally from one working area to another.

In a one embodiment, a plurality of connectors may connect the net to the cables, the cables may extend along a portion or all of a length of a structure, connected to at least two vertical structural members. The connectors are slideably attached to the cables, allowing them, and the net, to be slid along the cables when not secured. In operation, the net is secured to prevent accidental horizontal movement. Connectors may be any structure capable of attaching the net to the cables in a slideable manner. For example, connectors may be rings, carabineers, snap connectors, U bolts, and the like.

In another similar embodiment, the cable or rope may be weaved through the net edges. In this embodiment, the net may be similarly slideable, as described above.

In embodiments wherein the workers are adjacent to an edge of the structure, a perimeter net may be utilized to protect a worker in the event of a fall away from the structure. A lower edge of the perimeter net may be attached to the interior net at an interface of the edge of structure, on the side or sides of the interior net adjacent to the edge of the structure. An upper edge of the perimeter net may be secured slightly away from the edge of the structure, and slightly above the working area. As such, in some embodiments, the perimeter net may angle outwardly away from the interior net, thereby preventing a worker from falling over the perimeter net.

In further embodiments, the perimeter net may extend to be high enough that a worker could not fall over its top edge. For example, the perimeter net may extend approximately 42 inches above the top of the beams that workers are walking upon.

In still another embodiment, the perimeter net may be positioned at a sufficient distance away from the structure, and extend vertically to attach to the interior net which is extended away from the structure.

An outrigger or a plurality of outriggers may extend from a vertical support column to support the perimeter net away from the edge of the structure. In one embodiment, the outriggers may be pre-fabricated on a top of the vertical support column. In another embodiment, the outrigger may be removably attached to the vertical support column. In yet another embodiment, the outrigger may be attached to a top of the vertical support column. In one embodiment, the outriggers may extend no further than five feet from the outer face of the vertical support member.

One or a plurality of cables may extend downwardly from an outrigger. The cable may be attached to the perimeter net and may both support the net, guide the net up and down, and/or provide structure to the net by keeping the edges in place, depending on varying embodiments.

In embodiments having a substantially vertical perimeter net, and an interior net extending outwardly beyond a perimeter of the structure, the cables depending from the outrigger may pass substantially vertically downward. In some embodiments, the cables may reach to the ground and be anchored thereon. In embodiments having a perimeter net angled inward, attaching to the interior net at an edge of the structure, the cables may extend from the outrigger inward to the edge of the interior net.

One or a plurality of pulleys, such as a hoisting block, or blocks, may connect the cables to the outriggers. The pulleys may be used to raise and lower the perimeter net as required during construction. In one embodiment, the outrigger may comprise an eye bolt and nut assembly. The eye bolt may be used for supporting a pulley, and may also be used as a pivot point for a vertical skinner line that may act as a control track or guide for raising and lowering of the perimeter net.

As mentioned above, in some embodiments, in addition to the cables depending from the outrigger which support the net, one or a plurality of vertical skinner lines may be connected to the outriggers. The vertical skinner lines act only as a track to guide the raising and lowering of the perimeter net. The cables depending from the outriggers are configured to handle any loading on the net, while the vertical skinner lines guide the direction of the net when moved up or down.

In some embodiments, a perimeter stabilizer bar may be attached to the peripheral edge or edges of the interior net. The perimeter stabilizer bar may be any rigid material that may serve to stabilize and maintain security of the net. The perimeter stabilizer bar may be attached to the net in any manner. In one embodiment, the perimeter stabilizer bar may be woven through the net. In another embodiment, a plurality of connectors may connect the edge of the net to the perimeter stabilizer bar, along the length of the net. The perimeter stabilizer bar may be utilized on interior nets to connect one another, at a perimeter of a net to provide stability to the net, and/or to connect an interior net to a perimeter net.

In one embodiment, the perimeter stabilizer bar may further be attached to the perimeter net. The perimeter stabilizer bar may connect to the perimeter net in any manner.

In one embodiment, the perimeter net may be attached to the perimeter stabilizer bar in the same way that the interior net is attached. For example, a plurality of connectors may attach the interior net to the perimeter stabilizer bar. Similarly, a second plurality of connectors may attach the perimeter net to the perimeter stabilizer bar.

In operation, the fall protection system is positioned to provide complete fall protection around an area on which workers are working. When walking along beams and other structures forming a working area span, there is a possibility of falling two directions: inward into the working area, or outward, away from the working area. The fall protection system provides protection against both of these scenarios.

For example, if workers are working on a rectangular span having one border on the periphery of the structure, and three borders on the interior of the structure, the entire span will be protected against falls both inward and outward. In this example, a perimeter net will provide protection against an outward fall away from the structure. Further, the interior net (or nets) will provide fall protection for falls inward into the working span area (via a net within the working area), or outward away from the working area (via interior nets extending beyond the edge of the working area).

Initially, the net systems are assembled and laid out. Next they are attached at various points to the structure, depending on the required working area, as discussed above. Once attached, the nets can be raised or lowered as needed to the appropriate operational position, and then secured in place. Workers may safely work until finished with a particular working area span. Once finished, the nets may be moved to the next working span area. As workers move horizontally about the same level, the nets may be moved using the horizontal movement structures discussed above. As the workers then move upward with progressing construction, the nets may be either hoisted into position using the vertical movement structures discussed above, or, if needed, may be detached and re-attached at or near their operational levels.

Turning now to FIG. 1, a perspective view of an embodiment of the system is provided. Four columns 10 define an interior span above which workers may be working. A net 12 is positioned across this span. At its edges, the net 12 is supported by one or a plurality of outer cables or rope 13. The net 12 is connected to each column 10 by a clamp 11. The clamp 11 is slideably mounted to two flanges of the column 10, and is movable up and down the column 10. The net 12 is removably attached to the clamp 11 at connection point 14. In operation, the clamps 11 and net may be attached to the columns 10 at a convenient level and then raised or lowered into position as required.

Figure 2:
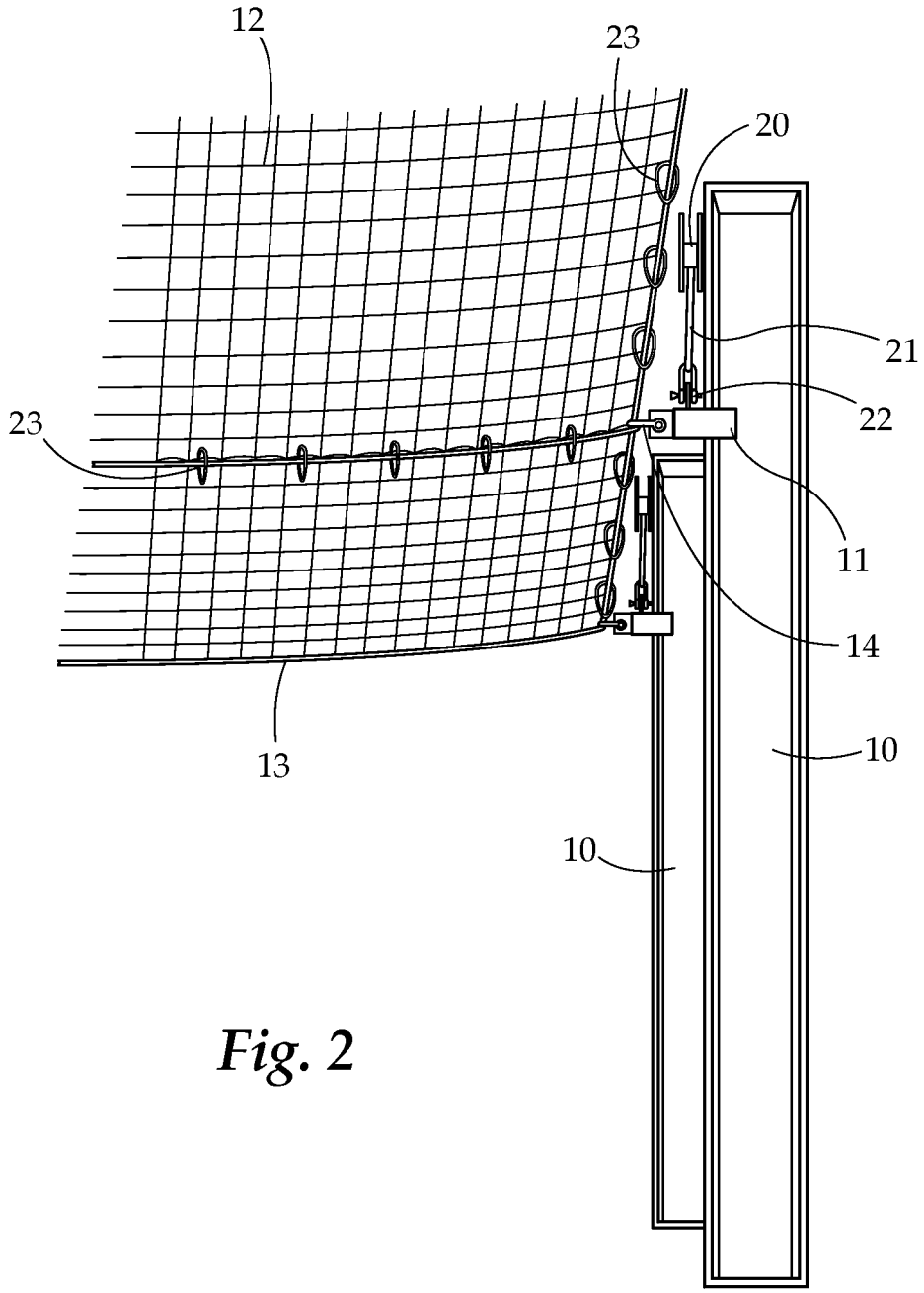
FIG. 2 provides a perspective view of another embodiment of the system.

FIG. 2 shows another embodiment of the system. In this view, the net 12 is attached to a plurality of columns 10. The net 12 is attached to the outer cables 13 by a plurality of connectors 23. These connectors 23 are slideable along the outer cables 13, facilitating movement of the net 12 from a first interior span to a second interior span. The net 12 is further connected to the clamp 11 at connection point 14. The clamp 11 is slideably mounted to two flanges of the column 10. A hoisting block 20 is attached to the column and positioned above the clamp 11. A cable 21 is supported by the hoisting block 20 and connects to the clamp 11 at point 22. As configured, when the clamp 11 is in an open position, it may be drawn upwards by application of proper tension to the cable 21. In some alternative embodiments, the interior net 12 is directly attached to a plurality of hoisting blocks 20. Cables 21 pass through these hoisting blocks 20 and are directly attached to the interior net 12. Upon securing the free ends of the cables 21, the interior net 12 may be adequately held in position. Upon release of the free ends of the cables, the interior net 12 may be raised or lowered as required for construction.

Figure 3:
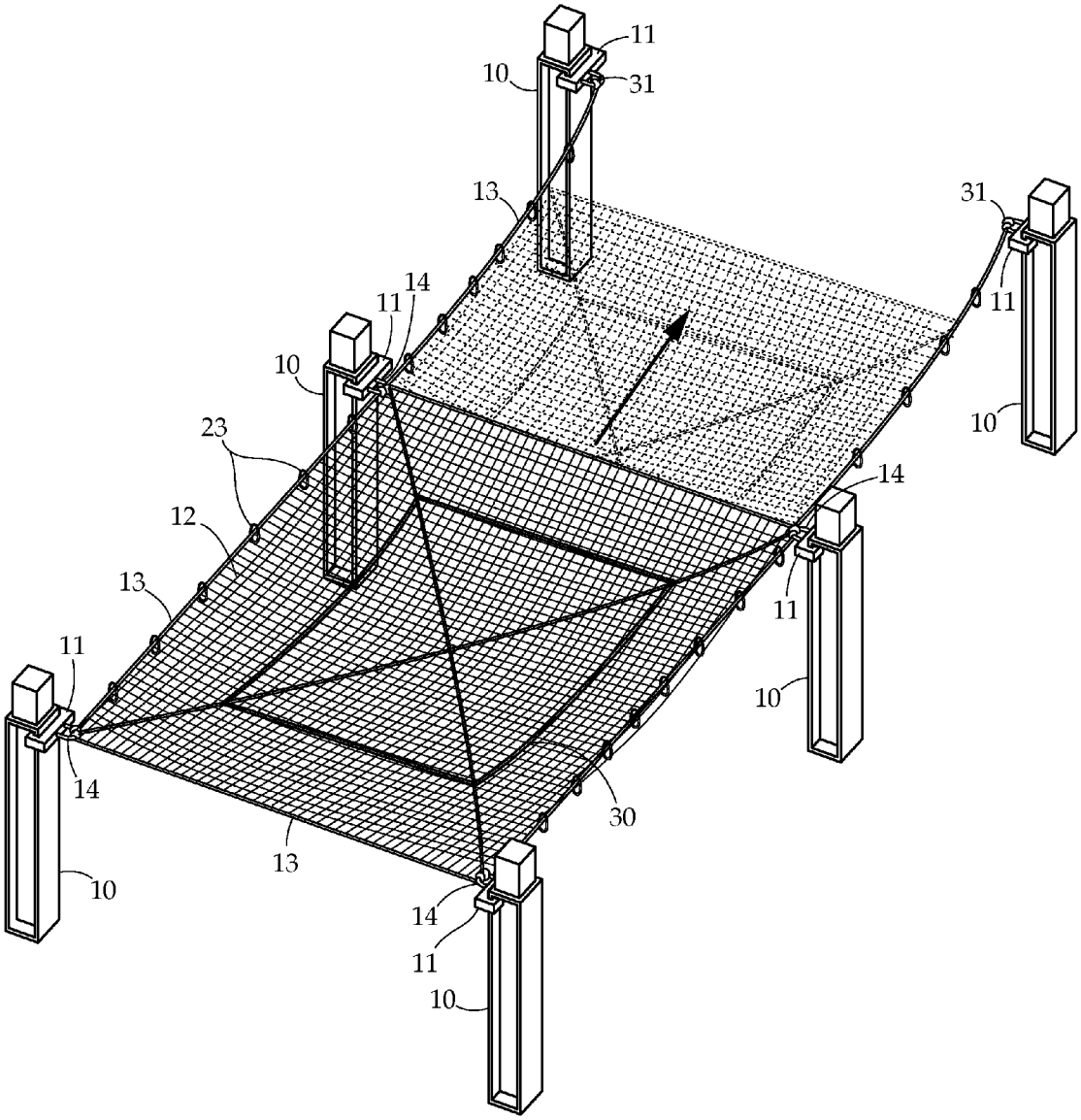
FIG. 3 provides a perspective view of another embodiment of the system.

FIG. 3 provides a perspective view of an embodiment of the system. In this view, four columns 10 define an interior span across which the net 12 is positioned. Further, four columns 10 define a second interior span where there is no net. In this embodiment, it can be seen how the interior net 12 may move horizontally from the first interior span to the second interior span.

At its edges, the net 12 is supported by an outer cable 13. The net 12 further comprises reinforcing ropes 30 about its surface that support and reinforce the net 12 across its span. The net 12 is connected to each column 10 by a clamp 11 but may alternatively be directly attached to the hoisting block 20. The clamp 11 is slideably mounted to two flanges of the column 10, and is movable up and down the column 10. The net 12 is removably attached to the clamp 11 at connection point 14. In operation, the clamps 11 and net 12 may be attached to the columns 10 at a convenient level and then raised or lowered into position as required. The net is connected to the outer cables by connectors 23. The connectors allow the net 12 to be slideable along the outer cables 13. The outer cables 13 extend to the columns 10 defining the second interior span, and are connected to the clamps 11 at connection points 14 and 31. To move the net 12 from the first span to the second span, first the net 12 may be detached from the clamp 11 at its connection point 14. Once the net 12 is removed from all clamps 11 it may be slid along the long outer cables 13 over to the second span. Once in position, the net 12 may be attached to the proper clamps 11 at attachment points 14 and 31, and is ready for operational use.

Figure 4:
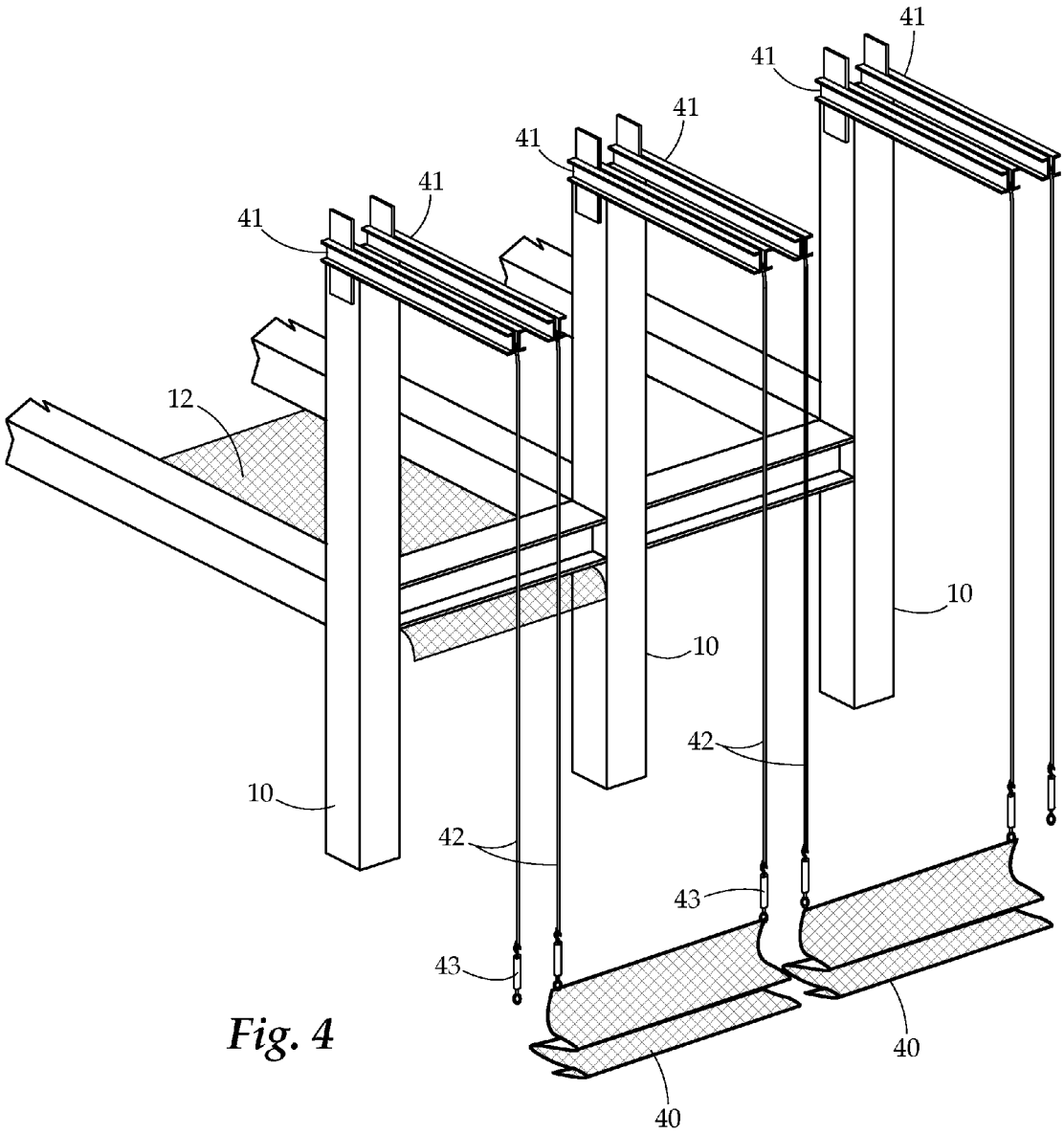
FIG. 4 provides a perspective view of still another embodiment of the system.

FIG. 4 provides a perspective view of another embodiment of the system. In this embodiment, a plurality of columns 10 form an interior span at an edge of a structure. A net 12 is positioned on an interior span of the structure formed by the columns 10. This net 12 is attachable to a perimeter net 40. The perimeter net 40 is supported by one or a plurality of outriggers 41 extending from a portion of the column 10. Cables 42 descend from the outriggers 41 and connect to the perimeter net 40. In one embodiment, weights 43 may be positioned at the end of the cables 42 to add stability to the perimeter net 40 or the cables 42 can be attached to a lower floor or structure. The perimeter net 40 may be raised up and down by movement of the cables 42 from a block 50 as needed to provide perimeter net protection in the event of a worker falling.

Figure 5:
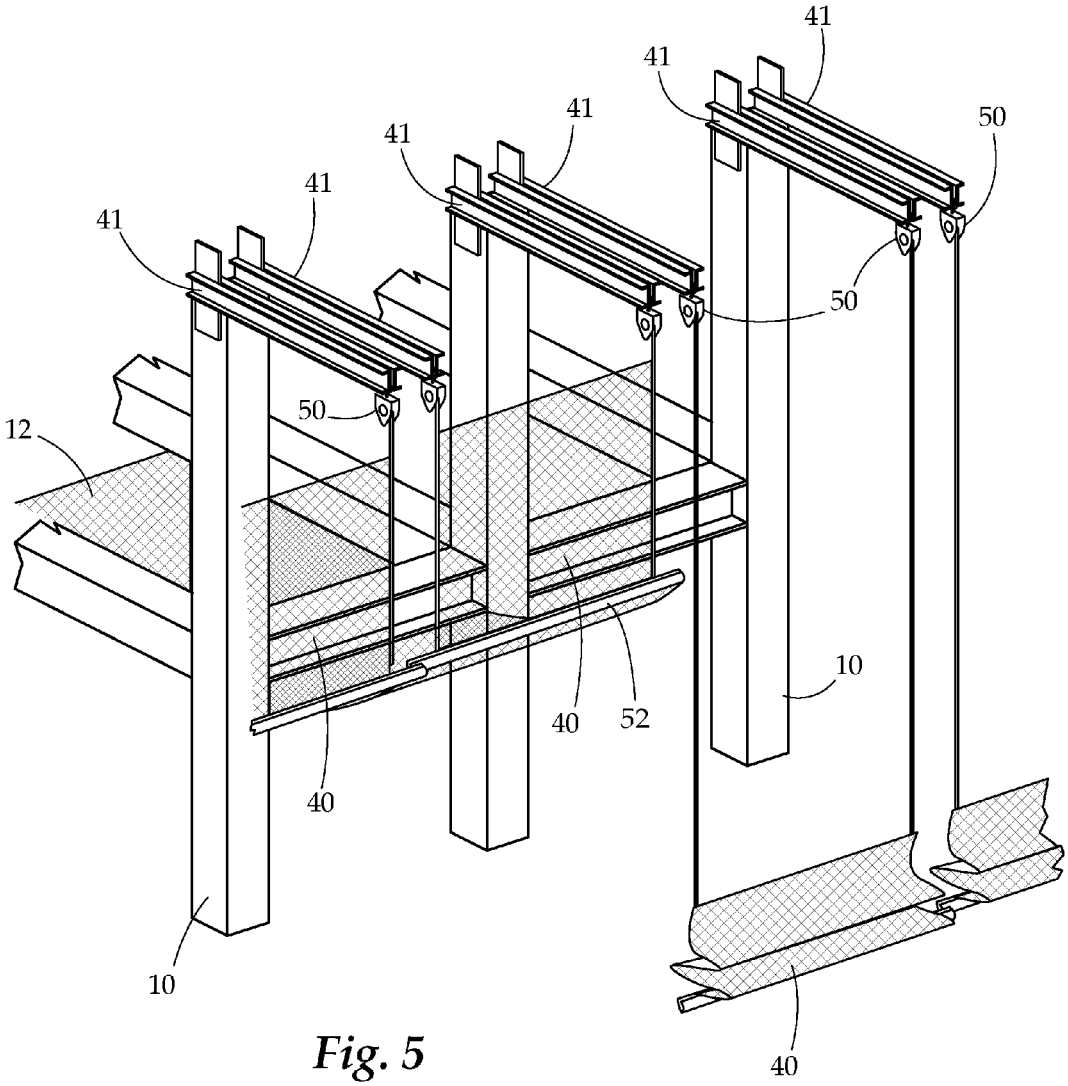
FIG. 5 provides a perspective view of yet another embodiment of the system.

FIG. 5 provides a perspective view of still another embodiment of the system. In this embodiment, a plurality of columns 10 form an interior span at an edge of a structure. A net 12 is positioned on an interior span of the structure formed by the columns 10. This net 12 is attached to a perimeter net 40 along a perimeter stabilizer bar 52. The perimeter net 40 is supported by one or a plurality of outriggers 41 extending from a portion of the column 10. Cables 42 supported by hoisting blocks 50 descend from the outriggers 41 and connect to the perimeter net 40. The position of the perimeter net 40 is adjustable by movement of the cables 42 supporting the perimeter net 40.

Figure 6:
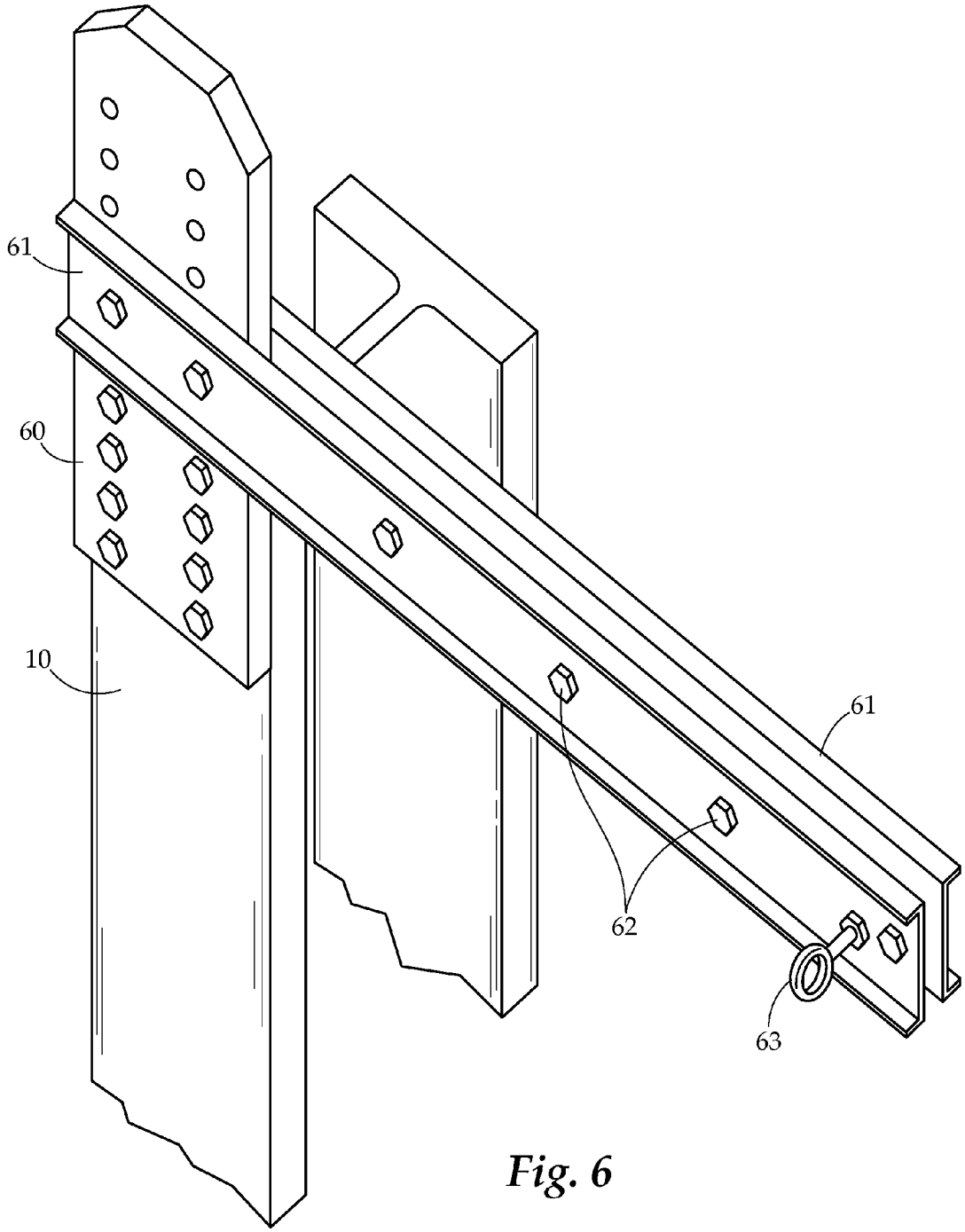
FIG. 6 provides a detail view of an embodiment of an outrigger.

FIG. 6 provides a perspective detail view of an outrigger configuration. In this embodiment, the outrigger extends perpendicularly to the column. However, it should be understood that it may extend at any angle, including extending at an upward angle, or downward angle. In this embodiment, the outrigger 41 is formed by two C-channels 62 attached back to back by bolts 62. The C-channels 62 are connected at a first end to a connector 60 connecting the outrigger 61 to the column 10. An eye bolt 63 is attached to a second end of one of the C-channels 61. A cable or hoisting block may be attached to the eye bolt 63 for support of the perimeter net (not shown). It should be understood that any structure capable of attaching to the column and extending therefrom may be used. In another exemplary embodiment, a clamping structure that clamps to a front and back of a column may be used. In this embodiment an outrigger may extend outward from the column. This outrigger may be angled upwardly, straight out, or downwardly, in varying embodiments.

Figure 7:
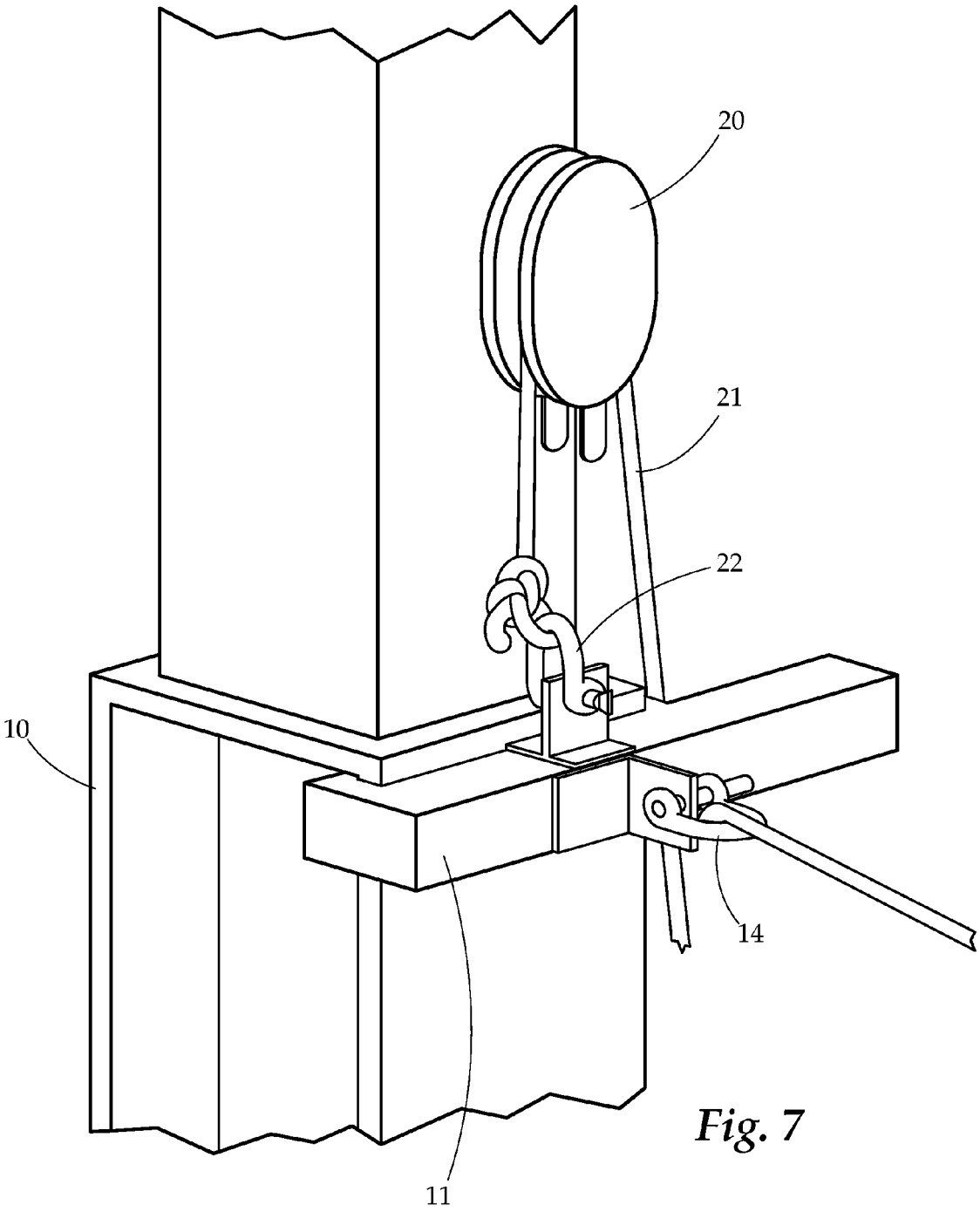
FIG. 7 provides a detail view of an embodiment of a clamp.

FIG. 7 provides a perspective detail view of an embodiment of the clamp. The clamp 11 is attached to two flanges of a column 10. A net (not shown) is attachable to the clamp 11 at connection point 14. A hoisting cable 21 is attached to the clamp 11 at connection 22. The cable 21 is run through a hoisting block 20. The cable 21 may be released, and when the clamp 11 is in an open position, it will slide downwardly along the two flanges of the column. Once the clamp is in its proper position, the clamp may be tightened to a clamping position, and secured to the column.

Figure 8:
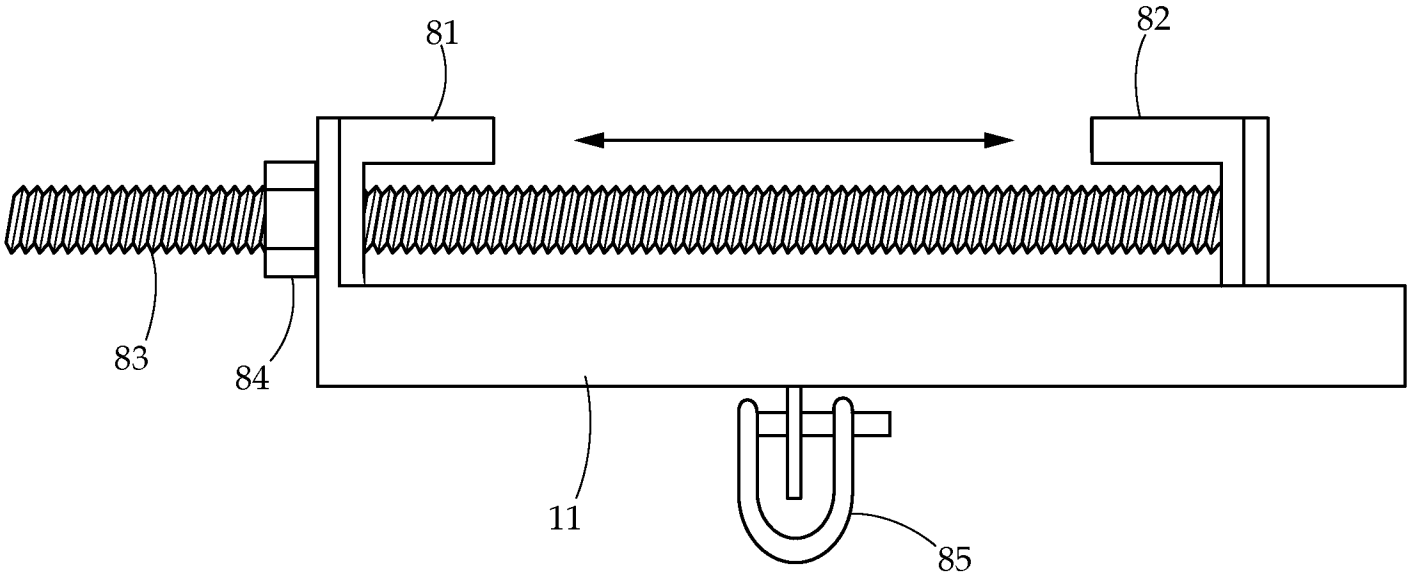
FIG. 8 provides a detail view of an embodiment of a clamp.

FIG. 8 provides a detail view of an embodiment of the clamp. The clamp 11 is formed of a C-channel having a first ninety degree angled metal 81 attached to a first end, and a second ninety degree angled metal 82 slideably attached along a base of the channel. The clamp is configured such that it may fit about two flanges of a column, with the inward projecting portion of the angled metals 81, 82, wrapping about the flanges, and the inward facing portions of the angled metals 81, 82 configured to clamp to a side of each flange. A connector 85 is attached to the clamp 11 to allow connection of the net (not shown) and/or outer cables. A threaded rod 83 extends from the first end of the C-channel to the second end. The threaded rod is attached to the second angled metal 82. A nut 84 is positioned on the first end of the C-channel and, by rotation, moves the threaded rod and attached second angled metal 82 in relation to the clamp 11, allowing tightening and loosening of the clamp 11.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A fall protection system comprising:

an interior net, the interior net positioned substantially horizontally across an interior span of a structure, the structure comprised of a plurality of columns;

a hoisting block directly attached to a first column of the plurality of columns, the hoisting block positioned above the interior net;

a cable having a first end attached to the interior net and a free second end, the cable disposed through the hoisting block such that the interior net is slideable upward and downward with relation to the first column based on tension applied to the free second end of the cable; and a clamp attached directly to the first column of the plurality of columns about two flanges extending perpendicularly in opposite directions from a central lengthwise bar of the first column, the clamp wrapping around an end of each flange and extending inwardly along the flange towards the bar, the clamp being slideable along the two flanges of the first column in an open position, and being locked to the two flanges in a closed position, the interior net connected to the clamp.

2. The fall protection system of claim 1 wherein the clamp further comprises:

a C-channel;

a first 90 degree angled metal attached to a first end of the C-channel;

a second 90 degree angled metal attached to a threaded connector, and slideable along the C-channel, the threaded connector attached to the first end of the C-channel opposite to the second 90 degree angled metal;

wherein a first rotation direction of the threaded connector adjusts a position of the second 90 degree angled metal, allowing the clamp to tighten about the two flanges of the first column, each 90 degree angled metal securing about one of the two flanges.

3. The fall protection system of claim 1 wherein the interior net is configured to be horizontally movable from the interior span to a second interior span.

4. The fall protection system of claim 3 further comprising a plurality of connectors connecting an edge of the interior net to a support cable, the support cable being connected to the first column and a second column of the plurality of columns, the support cable spanning both the interior span and the second interior span, the plurality of connectors being slideable along the support cable from the interior span to the second interior span, allowing the interior net to be horizontally movable along the support cable.

5. The fall protection system of claim 4 wherein the plurality of connectors is a plurality of carabineers.

6. The fall protection system of claim 1 wherein the clamp is removably connected to the net, and removable from the column.

7. The fall protection system of claim 1 further comprising a plurality of clamps, each of the plurality of clamps attached to one of the plurality of columns defining the interior span of the structure, and connected to the interior net.

* * * * *